US011958712B2

(12) United States Patent
Ohno

(10) Patent No.: US 11,958,712 B2
(45) Date of Patent: Apr. 16, 2024

(54) PAPER FEEDING DEVICE AND IMAGE PROCESSING APPARATUS

(71) Applicant: TOSHIBA TEC KABUSHIKI KAISHA, Tokyo (JP)

(72) Inventor: Masahiro Ohno, Yokohama Kanagawa (JP)

(73) Assignee: TOSHIBA TEC KABUSHIKI KAISHA, Shinagawa-ku (JP)

( * ) Notice: Subject to any disclaimer, the term of this patent is extended or adjusted under 35 U.S.C. 154(b) by 0 days.

(21) Appl. No.: 18/089,625

(22) Filed: Dec. 28, 2022

(65) Prior Publication Data

US 2023/0137449 A1 May 4, 2023

Related U.S. Application Data

(63) Continuation of application No. 17/013,888, filed on Sep. 8, 2020, now Pat. No. 11,565,900.

(51) Int. Cl.

| | |
|---|---|
| ***B65H 3/52*** | (2006.01) |
| ***B65H 3/06*** | (2006.01) |
| ***B65H 5/06*** | (2006.01) |

(52) U.S. Cl.

CPC ..... *B65H 5/062* (2013.01); *B65H 3/0669* (2013.01); *B65H 2402/52* (2013.01); *B65H 2404/1341* (2013.01); *B65H 2801/06* (2013.01)

(58) Field of Classification Search

CPC ..... B65H 3/5261; B65H 3/5215; B65H 3/52; B65H 5/062; B65H 3/0669;

(Continued)

(56) References Cited

U.S. PATENT DOCUMENTS

| | | | |
|---|---|---|---|
| 5,738,452 | A | 4/1998 | Uchida |
| 6,997,453 | B2 | 2/2006 | Matsuda et al. |

(Continued)

OTHER PUBLICATIONS

Non-Final Office Action for U.S. Appl. No. 17/013,888 dated Jun. 16, 2022.

*Primary Examiner* — Luis A Gonzalez

(74) *Attorney, Agent, or Firm* — Amin, Turocy & Watson, LLP

(57) ABSTRACT

A paper feeding device includes a paper feeding roller and a separation roller. The paper feeding roller and the separation roller are arranged in a parallel direction. The paper feeding roller and the separation roller interpose a sheet. The paper feeding device includes a paper feeding roller, a separation roller, a shaft, a holder, and a rotation stopping portion. The paper feeding roller is configured to convey the sheet in a conveyance direction. The separation roller is configured to be pressed against the paper feeding roller. The shaft is configured to rotatably support the separation roller via a torque limiter. The holder is configured to include a supporting portion. The supporting portion is provided with a first guide surface and a second guide surface facing each other and extending in the parallel direction. The rotation stopping portion is configured to be attached to the shaft. The rotation stopping portion is configured to be inserted between the first guide surface and the second guide surface. The rotation stopping portion is configured to include a first sliding surface and a second sliding surface. The first sliding surface faces the first guide surface on the paper feeding roller side of the parallel direction and a downstream side of the conveyance direction with respect to a rotation axis of the separation roller. The second sliding surface faces the second guide surface on an opposite side of the paper feeding roller of the parallel direction and an upstream side (Continued)

of the conveyance direction with respect to the rotation axis of the separation roller.

16 Claims, 5 Drawing Sheets

(58) Field of Classification Search
CPC ..... B65H 2801/06; B65H 2403/732; B65H 2402/32; B65H 2402/52; B65H 2402/53; B65H 2404/1341
See application file for complete search history.

(56) References Cited

U.S. PATENT DOCUMENTS

| | | | |
|---|---|---|---|
| 9,033,334 | B2 | 5/2015 | Yano |
| 9,796,545 | B2 | 10/2017 | Morizono et al. |
| 2006/0237895 | A1 | 10/2006 | Nishikata et al. |

PAPER FEEDING DEVICE AND IMAGE PROCESSING APPARATUS

CROSS-REFERENCE TO RELATED APPLICATION

This application is a Continuation of application Ser. No. 17/013,888 filed on Sep. 8, 2020, the entire contents of which are incorporated herein by reference.

FIELD

Embodiments described herein relate generally to a paper feeding device and an image processing apparatus.

BACKGROUND

In the related art, there is known a paper feeding device including a paper feeding roller that conveys a sheet and a separation roller that applies a load to the conveyed sheet. The separation roller separates overlapped sheets.

The separation roller is slidably supported in a state of being pressed against the paper feeding roller. If the sliding resistance is large in a sliding portion, the pressing of the separation roller against the paper feeding roller becomes incomplete. The paper feeding device is required to reduce the sliding resistance of the sliding portion that supports the separation roller.

DETAILED DESCRIPTION

Figure 1:
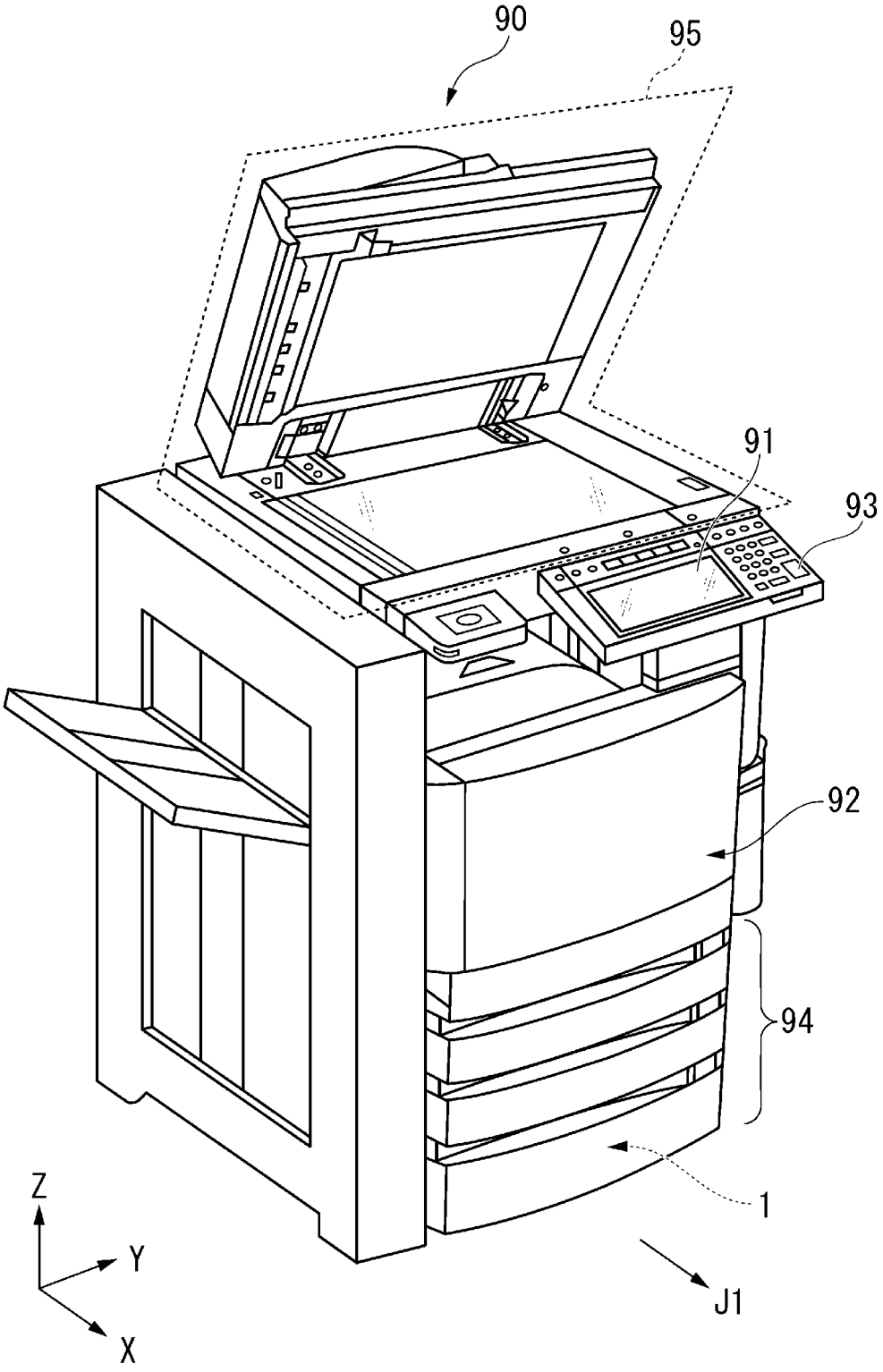
FIG. 1 is a perspective view illustrating an image processing apparatus of an embodiment.

In general, according to one embodiment, a paper feeding device includes a paper feeding roller and a separation roller. The paper feeding roller and the separation roller are arranged in a parallel direction. The paper feeding roller and the separation roller interpose a sheet. The paper feeding device includes a paper feeding roller, a separation roller, a shaft, a holder, and a rotation stopping portion. The paper feeding roller is configured to convey the sheet in a conveyance direction orthogonal to the parallel direction. The separation roller is configured to be pressed against the paper feeding roller. The shaft is configured to rotatably support the separation roller via a torque limiter. The holder is configured to include a supporting portion. The supporting portion is provided with a first guide surface and a second guide surface facing each other and extending in the parallel direction. The rotation stopping portion is configured to be attached to the shaft. The rotation stopping portion is configured to be inserted between the first guide surface and the second guide surface. The rotation stopping portion is configured to include a first sliding surface and a second sliding surface. The first sliding surface faces the first guide surface on the paper feeding roller side of the parallel direction and a downstream side of the conveyance direction with respect to a rotation axis of the separation roller. The second sliding surface faces the second guide surface on an opposite side of the paper feeding roller of the parallel direction and an upstream side of the conveyance direction with respect to the rotation axis of the separation roller.

Hereinafter, embodiments for carrying out the invention are described below with reference to the drawings. In each figure, the same parts are denoted by the same reference numerals.

Figure 2:
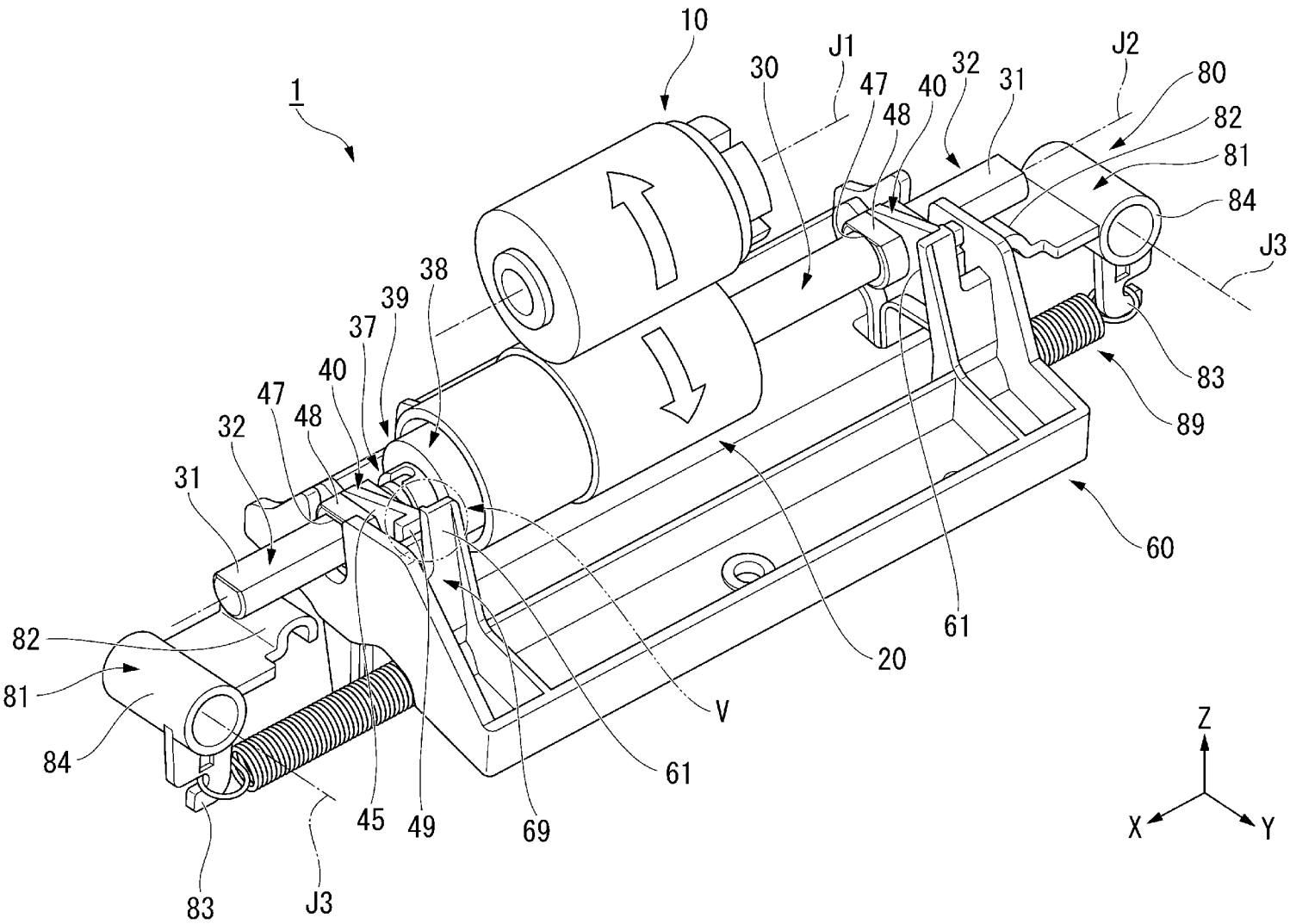
FIG. 2 is a perspective view of a paper feeding device of the embodiment.
Figure 3:
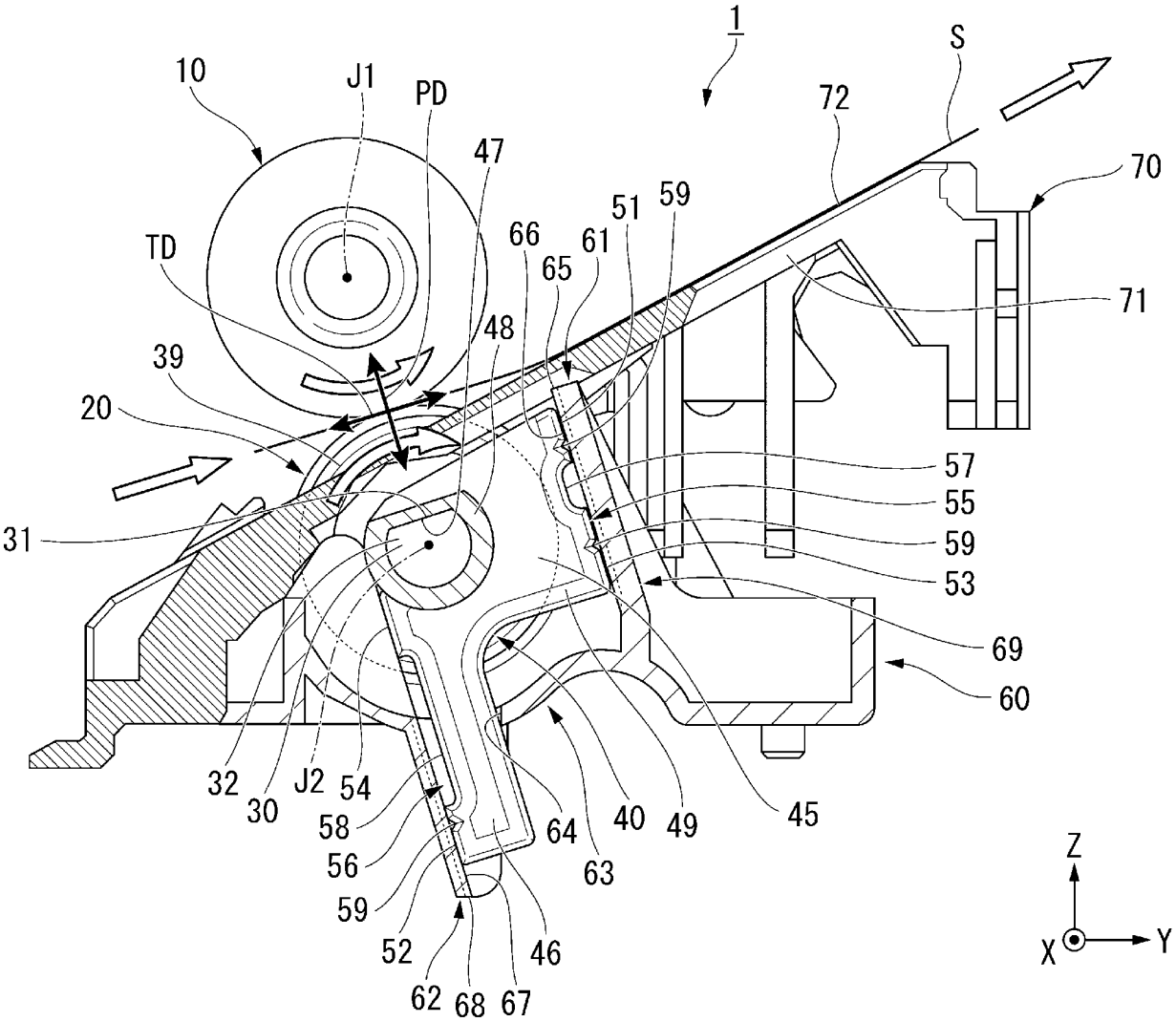
FIG. 3 is a sectional view of the paper feeding device.

FIG. 1 is a perspective view illustrating an image processing apparatus 90 including a paper feeding device 1 of the embodiment. FIG. 2 is a perspective view of the paper feeding device 1 of the embodiment. FIG. 3 is a sectional view of the paper feeding device 1 of the embodiment.

In the following, the description is made by using an orthogonal coordinate system of X, Y, and Z, if necessary. A predetermined direction in a horizontal plane is set as an X direction, a direction orthogonal to the X direction in the horizontal plane is set as a Y direction, a direction orthogonal to each of the X direction and the Y direction (that is, a vertical direction) is set as a Z direction. Among the X, Y, and Z directions, an arrow direction in the figure is set as a plus (+) direction, and a direction opposite to the arrow is set as a minus (−) direction. The +X direction is set as the front direction, the −X direction is set as the rear direction, the +Y direction is set as the right direction, the −Y direction is set as the left direction, the +Z direction is set as the upward direction, and the −Z direction is set as the downward direction.

The image processing apparatus 90 is described.

The image processing apparatus 90 of the present embodiment is a multifunction printer (MFP). For example, the image processing apparatus 90 forms an image on paper with a developer such as a toner. For example, the paper is paper or label paper. The paper may be any paper as long as an image can be formed on the surface thereof. In the example of FIG. 1, the image processing apparatus 90 includes a display 91, a printer unit 92, a control panel unit 93, a paper containing unit 94, and an image reading unit 95. The paper containing unit 94 includes a plurality of stages of paper feed cassettes arranged in the vertical direction (Z direction). The paper feeding device 1 of the embodiment is disposed inside the image processing apparatus 90 and on the upper side of at least one paper feed cassette. The paper feeding device 1 of the embodiment may be disposed in a sheet feeding port of a paper feeding tray for manual feeding.

According to the present embodiment, as an image processing apparatus on which the paper feeding device 1 is mounted, a multifunction printer is exemplified. However, the paper feeding device 1 may be mounted on other image processing apparatuses. As the image processing apparatus on which the paper feeding device 1 is mounted, an automatic document feeder, a scanner, and a decoloring device are exemplified.

The paper feeding device 1 is described.

As illustrated in FIGS. 2 and 3, the paper feeding device 1 includes a paper feeding roller 10, a separation roller 20, a torque limiter 39, a shaft 30, two rotation stopping portions 40, a holder 60, a sheet guide member 70 (see FIG. 3), and a pressure unit 80 (see FIG. 2). The paper feeding device 1 may further include a pickup roller (not illustrated). Here, the pickup roller supplies the uppermost sheet of the stacked paper bundle to the paper feeding roller 10.

As illustrated in FIG. 2, the paper feeding roller 10 has a cylindrical shape with a first rotation axis J1 as the center. The first rotation axis J1 of the present embodiment is parallel to the horizontal direction (X axis). The paper feeding roller 10 is connected to a drive unit (not illustrated).

The paper feeding roller 10 is driven and rotated with the first rotation axis J1 as the center.

The separation roller 20 is a cylindrical shape with a second rotation axis J2 as the center. The second rotation axis J2 of the present embodiment is parallel to the horizontal direction (X axis). The first rotation axis J1 and the second rotation axis J2 are parallel to each other.

As illustrated in FIG. 3, the separation roller 20 is arranged with the paper feeding roller 10 in a parallel direction PD. Here, the parallel direction PD is a direction in which the paper feeding roller 10 and the separation roller 20 are arranged. More specifically, the parallel direction PD is a direction in which a line segment that connects the first rotation axis J1 and the second rotation axis J2 extends when being viewed from the axial direction of the first rotation axis J1 and the second rotation axis J2. The parallel direction PD is orthogonal to the first rotation axis J1 and the second rotation axis J2.

As illustrated in FIG. 2, the separation roller 20 is supported by the shaft 30 via the torque limiter 39. The separation roller 20 is pressed against the paper feeding roller 10 by the pressure unit 80. The separation roller 20 is rotatable about the second rotation axis J2 as the center. The separation roller 20 rotates together with the paper feeding roller 10 by the frictional force acting on the outer peripheral surface.

A sheet S is interposed between the paper feeding roller 10 and the separation roller 20. The sheet S comes into contact with the paper feeding roller 10 on the upper surface. The sheet S comes into contact with the separation roller 20 on the lower surface. The paper feeding roller 10 is driven and rotated to convey the sheet S. If two or more of the sheets S are overlapped and fed, the separation roller 20 applies a load to the sheet S on the lower side due to the action of the torque limiter 39 and separates the upper sheet S.

As illustrated in FIG. 3, the sheet S interposed between the paper feeding roller 10 and the separation roller 20 is conveyed in a conveyance direction TD. Here, the conveyance direction TD is a direction orthogonal to the parallel direction PD when being viewed from the axial direction of the first rotation axis J1 and the second rotation axis J2. The conveyance direction TD is orthogonal to the first rotation axis J1 and the second rotation axis J2. In the present specification, a side to which the sheet S is discharged is referred to as "a downstream side of the conveyance direction TD". A side from which the sheet S is drawn is referred to as "an upstream side of the conveyance direction TD". In the present embodiment, the downstream side of the conveyance direction TD is a +Y side. In the present embodiment, the upstream side of the conveyance direction TD is a −Y side.

As illustrated in FIG. 2, the torque limiter 39 is disposed inside the separation roller 20. The torque limiter 39 includes an outer cylinder portion 38 fixed to the separation roller 20 and an inner cylinder portion 37 fixed to the shaft 30. Frictional force occurs between the outer cylinder portion 38 and the inner cylinder portion 37. The outer cylinder portion 38 and the inner cylinder portion 37 relatively rotate if a torque of a predetermined value or more is applied.

The shaft 30 extends in the horizontal direction with the second rotation axis J2 as the center. The shaft 30 has a cylindrical shape. The torque limiter 39 is fixed to the outer peripheral surface of the shaft 30. The shaft 30 rotatably supports the separation roller 20 via the torque limiter 39.

An upward force is applied from the pressure unit 80 to the end portions 32 on both sides of the shaft 30. As illustrated in FIG. 2, the pressure unit 80 includes two pressure levers 81 and a pressure spring 89. The pressure levers 81 includes cylinder portions 84, arm portions 82, and hook portions 83. The cylinder portion 84 has a tubular shape with a third rotation axis J3 as the center. The third rotation axis J3 extends along the Y axis. A support shaft (not illustrated) is inserted into the cylinder portion 84. The shaft 30 is rotatable about the third rotation axis J3. The arm portion 82 and the hook portion 83 are connected to the outer peripheral surface of the cylinder portion 84. The arm portions 82 are disposed on the lower sides of the end portions 32 of the shaft 30. The pressure spring 89 is hooked on the hook portions 83. The pressure spring 89 causes the pressure levers 81 to rotate about the third rotation axis J3. The pressure spring 89 presses the arm portions 82 against the end portions 32 of the shaft 30. The shaft 30 is pressed against the paper feeding roller 10 side by the pressure unit 80.

End portions 32 are provided with D-cut surfaces 31 on the both sides of the shaft 30. A cross section of the end portion 32 of the shaft 30 has a D shape. The rotation stopping portions 40 are attached to the end portions 32 on the both sides of the shaft 30. The torque limiter 39 and the separation roller 20 are disposed between the two rotation stopping portions 40 in the axial direction of the shaft 30.

The rotation stopping portion 40 has a flat plate shape along a plane (Y-Z plane) orthogonal to the second rotation axis J2. The rotation stopping portions 40 are provided with outer ribs 49 extending along the outer shape. The outer ribs 49 project on both sides of the rotation stopping portions 40 in the plate thickness direction. The outer ribs 49 reinforce the rotation stopping portions 40.

As illustrated in FIG. 3, the rotation stopping portion 40 includes a substantially rectangular main body portion 45 and a leg portion 46 extending downward from the main body portion 45. The leg portion 46 extends from the main body portion 45 in the parallel direction PD. The leg portion 46 extends in a direction of separating from the paper feeding roller 10.

Support holes 47 penetrate the main body portion 45 in the plate thickness direction. The support hole 47 has a D shape. The end portions 32 of the shaft 30 are inserted into the support holes 47. The relative rotation of the shaft 30 and the rotation stopping portions 40 is limited. Inner ribs 48 are provided on the inner edge of the support holes 47. The inner ribs 48 protrude in the plate thickness direction of the rotation stopping portions 40. The inner rib 48 enhances the rigidity of the rotation stopping portion 40 near the support hole 47. The inner rib 48 stabilizes the support of the shaft 30 by the rotation stopping portion 40.

A first end edge 55 and a second end edge 56 are provided on the outer peripheral edge of the rotation stopping portion 40. The first end edge 55 and the second end edge 56 each extend in substantially straight-line shapes in the parallel direction PD.

The first end edge 55 is positioned on the downstream side of the conveyance direction TD with respect to the second rotation axis J2. The first end edge 55 is an end edge of the main body portion 45. The second end edge 56 is positioned on the upstream side of the conveyance direction TD with respect to the second rotation axis J2. Meanwhile, the second end edge 56 is an end edge mounted over the main body portion 45 and the leg portion 46.

The first end edge 55 includes a first sliding surface 51 and a third sliding surface 53. Meanwhile, the second end edge 56 includes a second sliding surface 52 and a fourth sliding surface 54. That is, the rotation stopping portion 40 includes the first sliding surface 51, the second sliding surface 52, the third sliding surface 53, and the fourth sliding surface 54.

The first sliding surface 51 and the third sliding surface 53 face the downstream side of the conveyance direction TD. The first sliding surface 51 and the third sliding surface 53 are planes orthogonal to the conveyance direction TD. The first sliding surface 51 is disposed on the upper end side of the first end edge 55. Meanwhile, the third sliding surface 53 is disposed on the lower end side of the first end edge 55. The third sliding surface 53 is positioned on the opposite side of the paper feeding roller 10 in the parallel direction PD with respect to the first sliding surface 51. The third sliding surface 53 is disposed in the same planar shape as the first sliding surface 51. The first sliding surface 51 and the third sliding surface 53 are provided with recesses 59 containing grease.

A first cutout portion 57 is provided between the first sliding surface 51 and the third sliding surface 53. The first cutout portion 57 opens on the downstream side of the conveyance direction TD. The first cutout portion 57 depresses on the upstream side of the conveyance direction TD with respect to the first sliding surface 51 and the third sliding surface 53.

The second sliding surface 52 and the fourth sliding surface 54 face the downstream side of the conveyance direction TD. The second sliding surface 52 and the fourth sliding surface 54 are planes orthogonal to the conveyance direction TD. The second sliding surface 52 is disposed on the lower end side at the second end edge 56. The second sliding surface 52 is provided in the distal end portion of the leg portion 46. Meanwhile, the fourth sliding surface 54 is disposed on the upper end side at the second end edge 56. The main body portion 45 is provided with the fourth sliding surface 54. The fourth sliding surface 54 is positioned on the paper feeding roller 10 side of the parallel direction PD with respect to the second sliding surface 52. The fourth sliding surface 54 is disposed in the same planar shape as the second sliding surface 52. The second sliding surface 52 is provided with the recess 59 containing grease.

A second cutout portion 58 is provided between the second sliding surface 52 and the fourth sliding surface 54. The second cutout portion 58 opens on the upstream side of the conveyance direction TD. The second cutout portion 58 depresses on the downstream side of the conveyance direction TD with respect to the second sliding surface 52 and the fourth sliding surface 54.

The holder 60 supports the end portions 32 of the shaft 30 via the rotation stopping portions 40. The holder 60 is configured with a resin material. The holder 60 is disposed on the lower side of the separation roller 20.

The holder 60 includes two supporting portions 69 that each support the rotation stopping portions 40. As illustrated in FIG. 3, the supporting portion 69 of the present embodiment has a notch shape that opens upward. The supporting portion 69 includes a first facing wall 61, a second facing wall 62, and a bottom wall portion 63.

The first facing wall 61 and the second facing wall 62 face each other in the conveyance direction TD. The first facing wall 61 and the second facing wall 62 each extend in the parallel direction PD. The bottom wall portion connects the lower end portion of the first facing wall 61 and the lower end portion of the second facing wall 62.

The first facing wall 61 includes a first guide surface 66 that faces the upstream side of the conveyance direction TD. The second facing wall 62 includes a second guide surface 67 that faces the downstream side of the conveyance direction. The supporting portion 69 is provided with the first guide surface 66 and the second guide surface 67. The first guide surface 66 and the second guide surface 67 each include a flat surface extending in the parallel direction PD. The first guide surface 66 and the second guide surface 67 face each other in the conveyance direction TD.

Figure 4:
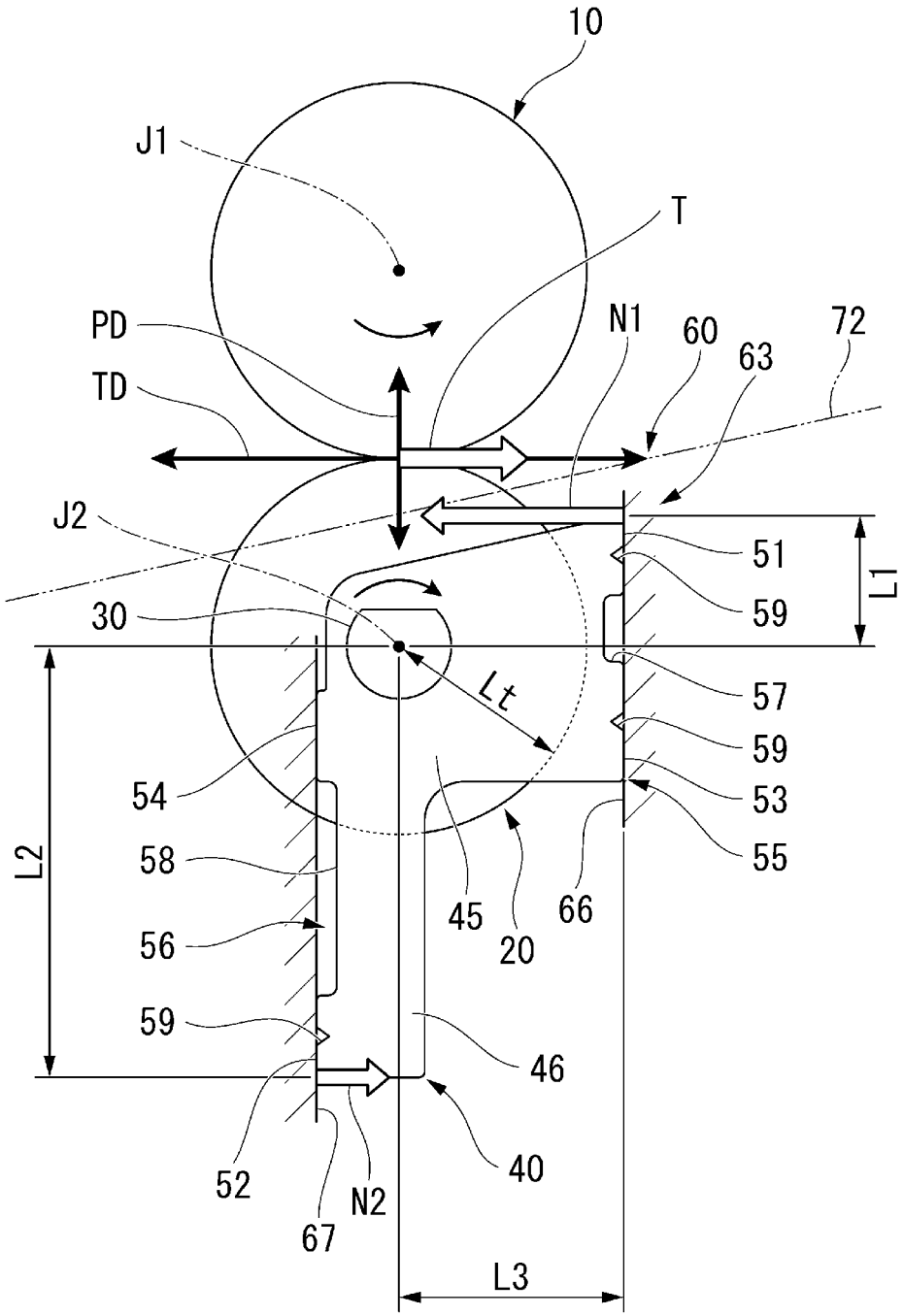
FIG. 4 is a schematic diagram of a supporting portion and a rotation stopping portion.

FIG. 4 is a diagram schematically illustrating a relationship between the supporting portion 69 and the rotation stopping portion 40.

The rotation stopping portion 40 is inserted between the first guide surface 66 and the second guide surface 67.

The first guide surface 66 faces the first sliding surface 51 and the third sliding surface 53 of the rotation stopping portion 40. The first sliding surface 51 and the third sliding surface 53 face the first guide surface 66 on the downstream side of the conveyance direction TD with respect to the second rotation axis J2. The first sliding surface 51 faces the first guide surface 66 on the paper feeding roller 10 side of the parallel direction PD with respect to the second rotation axis J2. The third sliding surface 53 faces the first guide surface 66 on the opposite side of the paper feeding roller 10 in the parallel direction PD with respect to the second rotation axis J2.

The second guide surface 67 faces the second sliding surface 52 and the fourth sliding surface 54 of the rotation stopping portion 40. The second sliding surface 52 and the fourth sliding surface 54 face the second guide surface 67 on the upstream side of the conveyance direction TD with respect to the second rotation axis J2. The second sliding surface 52 and the fourth sliding surface 54 face the second guide surface 67 on the opposite side of the paper feeding roller 10 in the parallel direction PD with respect to the second rotation axis J2.

The shaft 30 is pressed against the paper feeding roller 10 side by the pressure unit 80. If the sheet S is interposed between the paper feeding roller 10 and the separation roller 20, the interaxial distance between the first rotation axis J1 and the second rotation axis J2 changes. Here, the first sliding surface 51 and the third sliding surface 53 slide in the parallel direction PD with respect to the first guide surface 66. The second sliding surface 52 and the fourth sliding surface 54 slide in the parallel direction PD with respect to the second guide surface 67.

The width dimension of the rotation stopping portion 40 in the conveyance direction TD is slightly smaller than the distance between the first guide surface 66 and the second guide surface 67. The rotation stopping portion 40 can smoothly slide between the first guide surface 66 and the second guide surface 67.

The rotation stopping portion 40 faces the first guide surface 66 on the two sliding surfaces (the first sliding surface 51 and the third sliding surface 53) on the downstream side of the conveyance direction TD with respect to the second rotation axis J2. The rotation stopping portion 40 faces the second guide surface 67 on the two sliding surfaces (the second sliding surface 52 and the fourth sliding surface 54) on the upstream side of the conveyance direction TD with respect to the second rotation axis J2. According to the present embodiment, a large sliding area of the rotation stopping portion 40 in the parallel direction PD can be secured, and sliding efficiency can be improved. A plurality of sliding surfaces realize the rotation stop regardless of the direction of the rotation stopping portion 40 to which the moment is applied.

In the first end edge 55 of the rotation stopping portion 40, the first cutout portion 57 is provided between the first sliding surface 51 and the third sliding surface 53. The first sliding surface 51 and the third sliding surface 53 are partitioned by the first cutout portion 57. In the second end edge 56, the second cutout portion 58 is provided between the second sliding surface 52 and the fourth sliding surface 54. The second sliding surface 52 and the fourth sliding surface 54 are partitioned by the second cutout portion 58. The rotation stopping portion 40 comes into contact with the first guide surface 66 and the second guide surface 67 in a limited area. The dimension of the rotation stopping portion 40 is easily managed.

In the present embodiment, a portion between the first sliding surface 51 and the third sliding surface 53, and the first guide surface 66 is filled with grease that reduces the sliding resistance. A portion between the second sliding surface 52 and the fourth sliding surface 54, and the second guide surface 67 is filled with grease that reduces the sliding resistance.

The first sliding surface 51, the second sliding surface 52, and the third sliding surface 53 are provided with the recesses 59 containing grease. The recess 59 has a groove shape extending in the axial direction of the second rotation axis J2. The grease in the recess 59 is supplied to the first sliding surface 51, the second sliding surface 52, and the third sliding surface 53 and constantly reduces the sliding resistance.

According to the present embodiment, the fourth sliding surface 54 is not provided with the recess 59. However, all of the sliding surfaces (the first sliding surface 51, the second sliding surface 52, the third sliding surface 53, and the fourth sliding surface 54) may be provided with the recesses 59. If at least one sliding surface of all of the sliding surfaces is provided with the recess 59, a consistent effect can be obtained in view of the smoothness of sliding.

If the sheet S is conveyed to the downstream side of the conveyance direction TD, the moment is applied to the rotation stopping portion 40 as the reaction force of the torque limiter 39. The direction of the moment applied to the rotation stopping portion 40 is clockwise in FIG. 4. If the sheet S is conveyed to the downstream side, the first sliding surface 51 is pressed against the first guide surface 66. If the sheet S is conveyed to the downstream side, the second sliding surface 52 and the fourth sliding surface 54 are pressed against the second guide surface 67. The first guide surface 66 and the second guide surface 67 restrict the clockwise rotation of the rotation stopping portion 40. In contrast, if the sheet S moves backward to the upstream side, the third sliding surface 53 is pressed against the first guide surface 66. The first guide surface 66 restricts counterclockwise rotation of the rotation stopping portion 40. The first guide surface 66 and the second guide surface 67 restrict the rotation in any direction of the rotation stopping portion 40.

According to the present embodiment, the rotation stopping portion 40 includes the first sliding surface 51 and the second sliding surface 52. The first sliding surface 51 comes into contact with the first guide surface 66 on the downstream side of the conveyance direction TD and the separation roller 20 side of the parallel direction PD with respect to the second rotation axis J2. Meanwhile, the second sliding surface 52 comes into contact with the second guide surface 67 on the upstream side of the conveyance direction TD and the opposite side of the separation roller 20 in the parallel direction PD with respect to the second rotation axis J2. The moment applied to the separation roller 20 during the conveyance of the sheet S is effectively received on the first guide surface 66 and the second guide surface 67. The first sliding surface 51 and the second sliding surface 52 each are separated from the second rotation axis J2 in the parallel direction PD. The reaction force of the first guide surface 66 and the second guide surface 67 decreases. As a result, the sliding resistance applied between the first sliding surface 51 and the first guide surface 66 and between the second sliding surface 52 and the second guide surface 67 is reduced.

As illustrated in FIG. 4, the distance between the second rotation axis J2 and the first sliding surface 51 in the parallel direction PD is set as a first distance L1. The distance between the second rotation axis J2 and the second sliding surface 52 in the parallel direction PD is set as a second distance L2.

Slight gaps are provided between the first sliding surface 51 and the first guide surface 66 and between the second sliding surface 52 and the second guide surface 67. If the clockwise moment (FIG. 4) is applied to the rotation stopping portion 40, the first sliding surface 51 comes into contact with the first guide surface 66 at a point farthest from the second rotation axis J2 in the plane. A slight gap is provided between the first sliding surface 51 and the first guide surface 66. If the clockwise moment (FIG. 4) is applied to the rotation stopping portion 40, the second sliding surface 52 comes into contact with the second guide surface 67 at the farthest point from the second rotation axis J2 in the plane. Therefore, the first distance L1 is a distance between the farthest point from the second rotation axis J2 and the second rotation axis J2 in the first sliding surface 51. In the same manner, the second distance L2 is a distance between the farthest point from the second rotation axis J2 and the second rotation axis J2 in the second sliding surface 52.

Based on FIG. 4, the balance of the moment of the rotation stopping portion 40 during the conveyance of the sheet S is considered.

The force that the separation roller 20 applies to the sheet S during the conveyance of the sheet S is set as separating force T. The separation roller 20 receives the force of the separating force T from the sheet S as the reaction force. A moment of a product of the separating force T and a radius Lt of the separation roller 20 (T×Lt) is applied to the rotation stopping portion 40.

Meanwhile, the rotation stopping portion 40 comes into contact with the first guide surface 66 in the first sliding surface 51 and receives first reaction force N1. The rotation stopping portion 40 comes into contact with the second guide surface 67 in the second sliding surface 52 and receives second reaction force N2. A moment of a sum of a product of the first reaction force N1 and the first distance L1 (N1×L1) and a product of the second reaction force N2 and the second distance L2 (N2×L2) is applied to the rotation stopping portion 40.

In view of the balance of the moment of the rotation stopping portion 40, Equation (1) is established.

$$T \times Lt = (N1 \times L1) + (N2 \times L2) \quad (1)$$

The balance of the force of the rotation stopping portion 40 during the conveyance of the sheet S is considered.

The separating force T and the second reaction force N2 as the reaction force toward the downstream side of the conveyance direction TD and the first reaction force N1 as the reaction force toward the upstream side of the conveyance direction TD are applied to the rotation stopping portion 40.

In view of the balance of the force of the rotation stopping portion 40, Equation (2) is established.

$$T + N2 = N1 \quad (2)$$

From Equation (2), the first reaction force N1 is always larger than the second reaction force N2. In order to smooth the sliding of the rotation stopping portion 40 in the supporting portion 69, it is important to reduce the first reaction force N1.

From Equations (1) and (2), Equations (3) and (4) are derived.

$$N1=T\times(Lt+L2)/(L1+L2) \quad (3)$$

$$N2=T\times(Lt-L1)/(L1+L2) \quad (4)$$

From Equations (3) and (4), the first reaction force N1 and the second reaction force N2 are reduced by causing the first distance L1 to be a value of larger than 0. According to the present embodiment, since the first distance L1 is a value of larger than 0, the first reaction force N1 is reduced, and the sliding of the rotation stopping portion 40 in the supporting portion 69 is smoothed.

The first distance L1 of the present embodiment is larger than a half of the radius Lt of the separation roller 20. The first reaction force N1 is effectively reduced by causing the first distance L1 to be larger than a half of the radius Lt of the separation roller 20.

The first distance L1 is preferably smaller than the radius Lt of the separation roller 20. If the first distance L1 is larger than the radius Lt of the separation roller 20, the first sliding surface 51 is disposed on the paper feeding roller 10 side with respect to the sheet S. Here, in order not to allow the rotation stopping portion 40 to prevent the conveyance of the sheet S, the first sliding surface 51 is disposed on the outside of the passage area of the sheet S. Here, there is a concern that the size of the paper feeding device 1 increases. According to the present embodiment, by causing the first distance L1 to be smaller than the radius Lt of the separation roller 20, the size of the paper feeding device 1 can be reduced.

From Equation (4), it is understood that the second reaction force N2 can be reduced by increasing the second distance L2. According to the present embodiment, since the second distance L2 is a sufficiently large value, the second reaction force N2 can be reduced, and the sliding of the rotation stopping portion 40 in the supporting portions 69 can be smoothed.

The second distance L2 of the present embodiment is larger than the radius Lt of the separation roller 20. The second reaction force N2 is effectively reduced by causing the second distance L2 to be larger than the radius Lt of the separation roller 20.

According to the present embodiment, the rotation stopping portions 40 are attached to the shaft 30 in the end portions 32 that interpose the separation roller 20. The holder 60 includes the two supporting portions 69 that each support the rotation stopping portions 40. The first reaction force N1 and the second reaction force N2 are received by the two rotation stopping portions 40 in a dispersed manner. The first reaction force N1 and the second reaction force N2 applied to each of the rotation stopping portions 40 can be reduced, and the sliding of the rotation stopping portions 40 can be smoothed. The rotation of the shaft 30 is restricted by the end portions 32 on both sides, and the skew of the shaft 30 is reduced.

Figure 5:
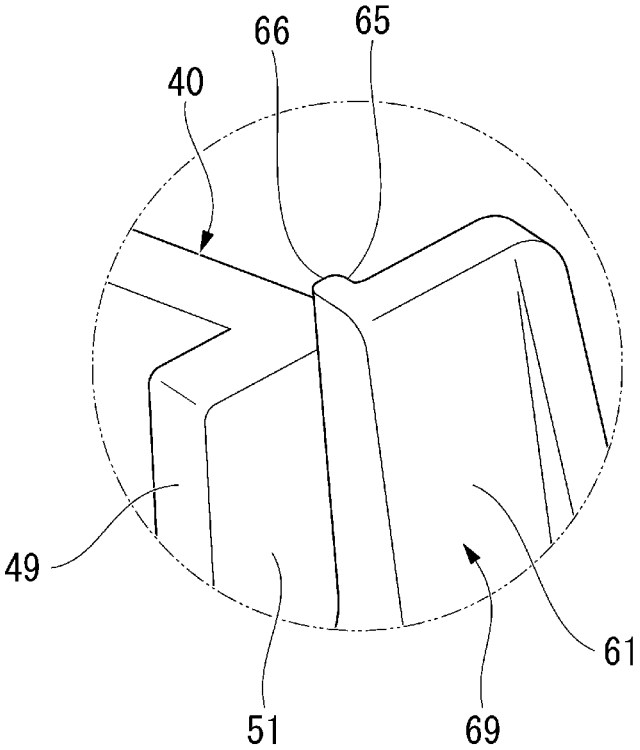
FIG. 5 is a partially enlarged view of an area V of FIG. 2.

FIG. 5 is a partially enlarged view of an area V of FIG. 2. As illustrated in FIG. 5, the first facing wall 61 of the supporting portion 69 includes a first rib (rib) 65.

As illustrated in FIG. 3, the first rib 65 extends in the parallel direction PD. The first rib 65 protrudes to the upstream side of the conveyance direction TD. The first rib 65 is provided with the first guide surface 66. The contact area between the supporting portion 69 and the first sliding surface 51 can be limited by providing the first guide surface 66 at the distal end of the first rib 65. Accordingly, the dimension of the first guide surface 66 is easily managed.

The second facing wall 62 of the supporting portion 69 includes a second rib (rib) 68. The second rib 68 extends in the parallel direction PD. The second rib 68 protrudes to the downstream side of the conveyance direction TD. The second rib 68 is provided with the second guide surface 67. The contact area between the supporting portion 69 and the second sliding surface 52 can be limited by providing the second guide surface 67 at the distal end of the second rib 68. Accordingly, the dimension of the second guide surface 67 is easily managed.

As illustrated in FIG. 3, a through hole 64 penetrates the bottom wall portion 63 of the supporting portion 69 in the thickness direction. The leg portion 46 of the rotation stopping portion 40 is inserted into the through hole 64.

According to the present embodiment, the leg portion 46 having the second sliding surface 52 is inserted into the through hole 64 of the holder 60. The second distance L2 can be secured to be large by providing the second sliding surface 52 in the leg portion 46. The dimension of the holder 60 in the parallel direction PD is reduced by inserting the leg portion 46 to the through hole 64. The size of the paper feeding device 1 can be reduced.

As illustrated in FIG. 3, the sheet guide member 70 includes a plate-shaped guide plate 71. The guide plate 71 covers the holder 60 from the upper side. An opening (not illustrated) that exposes the separation roller 20 is provided on the guide plate 71. The guide plate 71 includes a sheet guide surface 72 that faces the upper side. That is, the sheet guide member 70 is provided with the sheet guide surface 72. The sheet guide surface 72 guides the conveyed sheet S.

According to the present embodiment, the sheet guide surface 72 is inclined to the conveyance direction TD. More specifically, the sheet guide surface 72 is inclined to the paper feeding roller 10 side toward downstream side of the conveyance direction TD when being viewed in the axial direction of the separation roller 20.

The sheet S is conveyed between the paper feeding roller 10 and the separation roller 20 in the conveyance direction TD. The sheet S is conveyed in a manner of being bent in contact with the sheet guide surface 72 on the downstream side of the paper feeding roller 10 and the separation roller 20.

The space of the separation roller 20 on the downstream side of the conveyance direction TD is secured to be large by causing the sheet guide surface 72 to be inclined to the paper feeding roller 10 side on the downstream side of the conveyance direction TD. The position of the first sliding surface 51 in the parallel direction PD can come closer to the paper feeding roller 10 side. The first distance L1 becomes large, and the sliding between the rotation stopping portion 40 and the supporting portion 69 becomes smooth.

As illustrated in FIG. 4, the distance between the second rotation axis J2 and the first sliding surface 51 in the conveyance direction TD is set as a third distance L3. According to the present embodiment, the third distance L3 is larger than the radius Lt of the separation roller 20. As described above, the sheet guide surface 72 comes closer to the paper feeding roller 10 side on the downstream side of the conveyance direction TD. The first sliding surface 51 can become closer to the paper feeding roller 10 side in the parallel direction PD by causing the third distance L3 to be large and disposing the first sliding surface 51 on the downstream side of the conveyance direction TD. The first distance L1 becomes large, and the sliding between the rotation stopping portion 40 and the supporting portion 69 becomes smooth.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A paper feeding device, comprising:

a paper feeding roller and a separation roller arranged in a parallel direction and configured to interpose a sheet, the paper feeding roller configured to convey the sheet in a conveyance direction orthogonal to the parallel direction, the separation roller configured to be pressed against the paper feeding roller;

a shaft configured to rotatably support the separation roller via a torque limiter;

a holder comprising a supporting portion provided with a first guide surface and a second guide surface facing each other and extending in the parallel direction; and a rotation stopping portion attachable to the shaft, insertable between the first guide surface and the second guide surface, and comprising a first sliding surface that faces the first guide surface on the paper feeding roller side of the parallel direction and a downstream side of the conveyance direction and a second sliding surface that faces the second guide surface on an opposite side of the paper feeding roller of the parallel direction and an upstream side of the conveyance direction with respect to a rotation axis of the separation roller, wherein the first sliding surface includes a portion formed above a rotation axis of the separation roller in a parallel direction, the second sliding surface formed only below the rotation axis of the separation roller in the parallel direction, wherein a distance between the rotation axis of separation roller and the first sliding surface in the parallel direction is smaller than a radius of the separation roller, and wherein the distance between the rotation axis of separation roller and the first sliding surface in the parallel direction is larger than a half of the radius of the separation roller.

2. The paper feeding device according to claim 1, wherein a distance between the rotation axis of the separation roller and the second sliding surface in the parallel direction is larger than a radius of the separation roller.

3. The paper feeding device according to claim 1, wherein the rotation stopping portion is attached to the shaft in each end portion on both sides that interpose the separation roller, and the holder includes two supporting portions that each support the rotation stopping portions.

4. The paper feeding device according to claim 1, further comprising:

a sheet guide member comprising a sheet guide surface that guides the conveyed sheet, wherein the sheet guide surface is inclined to the paper feeding roller side toward the downstream side of the conveyance direction when viewed in an axial direction of the separation roller.

5. The paper feeding device according to claim 1, wherein the rotation stopping portion comprises a third sliding surface that is disposed in the same planar shape as the first sliding surface and faces the first guide surface and a fourth sliding surface that is disposed in the same planar shape as the second sliding surface and faces the second guide surface.

6. The paper feeding device according to claim 1, wherein the supporting portion comprises a rib extending in the parallel direction and provided with the first guide surface or the second guide surface.

7. The paper feeding device according to claim 1, wherein the rotation stopping portion comprises a leg portion extending in the parallel direction, a distal end portion of the leg portion is provided with the second sliding surface, and the supporting portion is provided with a through hole into which the leg portion is insertable.

8. The paper feeding device according to claim 1, wherein the paper feeding roller is configured to convey a single sheet in the conveyance direction orthogonal to the parallel direction, with the proviso that two or more sheets are not conveyed at one time by the paper feeding roller.

9. An image processing apparatus, comprising:

an image forming component that forms an image on a sheet; and a paper feeding device that delivers the sheet to the image forming component, paper feeding device comprising:

a paper feeding roller and a separation roller arranged in a parallel direction and configured to interpose the sheet, the paper feeding roller configured to convey the sheet in a conveyance direction orthogonal to the parallel direction, the separation roller configured to be pressed against the paper feeding roller;

a shaft configured to rotatably support the separation roller via a torque limiter;

a holder comprising a supporting portion provided with a first guide surface and a second guide surface facing each other and extending in the parallel direction; and a rotation stopping portion attachable to the shaft, insertable between the first guide surface and the second guide surface, and comprising a first sliding surface that faces the first guide surface on the paper feeding roller side of the parallel direction and a downstream side of the conveyance direction and a second sliding surface that faces the second guide surface on an opposite side of the paper feeding roller of the parallel direction and an upstream side of the conveyance direction with respect to a rotation axis of the separation roller, wherein the first sliding surface includes a portion formed above a rotation axis of the separation roller in a parallel direction, the second sliding surface formed only below the rotation axis of the separation roller in the parallel direction, wherein a distance between the rotation axis of separation roller and the first sliding surface in the parallel direction is smaller than a radius of the separation roller, and wherein the distance between the rotation axis of the separation roller and the first sliding surface in the parallel direction is larger than a half of the radius of the separation roller.

10. The image processing apparatus according to claim 9, wherein a distance between the rotation axis of the separation roller and the second sliding surface in the parallel direction is larger than a radius of the separation roller.

11. The image processing apparatus according to claim 9, wherein the rotation stopping portion is attached to the shaft in each end portion on both sides that interpose the separation roller, and the holder includes two supporting portions that each support the rotation stopping portions.

12. The image processing apparatus according to claim 9, further comprising:

a sheet guide member comprising a sheet guide surface that guides the conveyed sheet, wherein the sheet guide surface is inclined to the paper feeding roller side toward the downstream side of the conveyance direction when viewed in an axial direction of the separation roller.

13. The image processing apparatus according to claim 9, wherein the rotation stopping portion comprises a third sliding surface that is disposed in the same planar shape as the first sliding surface and faces the first guide surface and a fourth sliding surface that is disposed in the same planar shape as the second sliding surface and faces the second guide surface.

14. The image processing apparatus according to claim 9, wherein the supporting portion comprises a rib extending in the parallel direction and provided with the first guide surface or the second guide surface.

15. The image processing apparatus according to claim 9, wherein the rotation stopping portion comprises a leg portion extending in the parallel direction, a distal end portion of the leg portion is provided with the second sliding surface, and the supporting portion is provided with a through hole into which the leg portion is insertable.

16. The image processing apparatus according to claim 9, wherein the paper feeding roller is configured to convey a single sheet in the conveyance direction orthogonal to the parallel direction, with the proviso that two or more sheets are not conveyed at one time by the paper feeding roller.

* * * * *